US009699551B2

(12) United States Patent
Yang et al.

(10) Patent No.: US 9,699,551 B2
(45) Date of Patent: Jul. 4, 2017

(54) ANALOGUE SIGNAL PROCESSING CIRCUIT FOR MICROPHONE

(71) Applicant: HYUNDAI MOTOR COMPANY, Seoul (KR)

(72) Inventors: Sang-Hyeok Yang, Suwon-si (KR); Sang Gyu Park, Seoul (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 14/853,616

(22) Filed: Sep. 14, 2015

(65) Prior Publication Data

US 2016/0112796 A1 Apr. 21, 2016

(30) Foreign Application Priority Data

Oct. 20, 2014 (KR) ..... 10-2014-0142066

(51) Int. Cl.
*H04R 3/02* (2006.01)
*H04R 3/00* (2006.01)

(52) U.S. Cl.
CPC ..... *H04R 3/00* (2013.01); *H04R 2410/03* (2013.01)

(58) Field of Classification Search
CPC ..... H04R 3/02
USPC ..... 330/259, 253, 258, 261; 379/387.01; 381/92, 94.1, 95, 111, 120, 122, 355, 58, 381/113, 114, 174; 327/67, 563; 345/205
See application file for complete search history.

(56) References Cited

U.S. PATENT DOCUMENTS 4,742,308 A * 5/1988 Banu ..... H03F 3/45659 330/252
5,130,666 A 7/1992 Nicollini
5,596,289 A * 1/1997 Liu ..... H03F 3/3023 327/345
5,812,022 A * 9/1998 Hirano ..... H03F 3/45076 327/391
6,731,748 B1 * 5/2004 Edgar, III ..... H04M 1/60 379/27.01
7,072,478 B2 * 7/2006 Hohendahl ..... H03F 1/22 381/111

(Continued)

FOREIGN PATENT DOCUMENTS

JP 2004527169 A 9/2004
KR 10-2002-0068968 A 8/2002

(Continued)

OTHER PUBLICATIONS

Hussain Alzaher et al., "A CMOS Fully Balanced Difference Amplifier and Its Applications", IEEE Transactions on Circuits and Systems—II: Analog and Digital Signal Processing, vol. 48, No. 6, Jun. 2001, pp. 614-620.

*Primary Examiner* — Gerald Gauthier
(74) *Attorney, Agent, or Firm* — McDermott Will & Emery LLP

(57) ABSTRACT

An analog signal processing circuit of a microphone includes a bias circuit including a first sub-circuit which receives a signal from the microphone to output a first signal and a second sub-circuit which receives a reference voltage to output a second signal. A fully differential circuit receives the first signal and the second signal to output a fully differential signal. Each of the first sub-circuit and the second sub-circuit includes a bias sub-circuit to apply a bias voltage.

8 Claims, 2 Drawing Sheets

(56) References Cited

U.S. PATENT DOCUMENTS 7,259,627 B1 * 8/2007 Dhanasekaran ..... H03F 3/181 330/259
7,368,990 B2 * 5/2008 Tsuchi ..... H03F 3/45179 330/253
7,466,835 B2 * 12/2008 Stenberg ..... H04R 19/04 381/174
7,619,474 B2 * 11/2009 Fukukaza ..... G01C 19/5607 330/253
8,704,810 B2 * 4/2014 Tsuchi ..... G09G 3/3291 345/205
2004/0208327 A1 * 10/2004 Henson ..... H04R 3/00 381/113
2008/0285776 A1 * 11/2008 Wu ..... H04R 1/04 381/114
2009/0003629 A1 * 1/2009 Shajaan ..... H04R 1/005 381/113
2009/0110213 A1 * 4/2009 Holzmann ..... H04R 19/016 381/95
2011/0293115 A1 * 12/2011 Henriksen ..... H03F 1/301 381/111
2012/0014541 A1 * 1/2012 Nakayama ..... H03F 1/52 381/111
2012/0121106 A1 * 5/2012 Henriksen ..... H03F 1/3211 381/94.1
2012/0140956 A1 * 6/2012 Poulsen ..... H04R 1/04 381/111
2012/0250881 A1 * 10/2012 Mulligan ..... H03F 1/0261 381/92
2012/0308051 A1 * 12/2012 Eriksson ..... H03F 3/183 381/120
2014/0133685 A1 * 5/2014 Liu ..... H04R 7/20 381/355
2014/0254809 A1 * 9/2014 Fan ..... H04R 29/00 381/58
2016/0112796 A1 * 4/2016 Yang ..... H04R 3/00 381/122

FOREIGN PATENT DOCUMENTS

KR 10-0408796 B1 3/2004
KR 10-1151985 B1 6/2012
WO 03/049282 A1 6/2003

* cited by examiner

ANALOGUE SIGNAL PROCESSING CIRCUIT FOR MICROPHONE

CROSS-REFERENCE TO RELATED APPLICATION

This application claims the benefit of priority to Korean Patent Application No. 10-2014-0142066 filed in the Korean Intellectual Property Office on Oct. 20, 2014, the entire content of which is incorporated herein by reference.

TECHNICAL FIELD

The present disclosure relates to a microphone. More particularly, the present disclosure relates to an analog signal processing circuit of the microphone.

BACKGROUND

A microphone is extensively used in a mobile device, an audio device, a vehicle, or the like to detect and convert a sound, that is, a sound wave, into a physical value or an electrical value. The converted signal is finally processed to a signal recognizable by a person or a machine.

Since the microphone receives a natural signal such as the sound wave, analog signal processing is essential to convert the signal. An analog signal processing circuit may have a direct influence on the entire performance of the microphone. Particularly, since the microphone receives a wide frequency range as an input due to a characteristic thereof, a noise characteristic is important.

Since a signal output from the microphone is a single signal, an output signal needs to be converted into a full differential signal that is advantageous for the noise characteristic. Further, an input stage DC bias function and an amplification rate control function to control a size, that is, sensitivity of the signal, may be essential in a fully differential structure. In general, the analog signal processing circuit is configured by a combination of circuits to implement the above functions. However, the combination of the circuits may result in an increase of electrical noise.

The above information disclosed in this Background section is only for enhancement of understanding of the background of the disclosure, and therefore, it may contain information that does not form the prior art that is already known in this country to a person of ordinary skill in the art.

SUMMARY

The present disclosure has been made in an effort to provide an analog signal processing circuit for a microphone having advantages of including functions necessary to process an analog signal of the microphone and having an improved noise characteristic.

According to an exemplary embodiment of the present inventive concept, an analog signal processing circuit of a microphone includes a bias circuit including a first sub-circuit which receives a signal from the microphone to output a first signal and a second sub-circuit which receives a reference voltage to output a second signal. A fully differential circuit receives the first signal and the second signal to output a fully differential signal. The first sub-circuit includes a first bias sub-circuit to apply a bias voltage, and the second sub-circuit includes a second bias sub-circuit to apply a bias voltage.

The first and second bias sub-circuits may include two anti-parallel diode pairs.

Different reference voltages may be applied to the anti-parallel diode pairs, respectively.

The first sub-circuit may include a first capacitor between the microphone and the first bias sub-circuit and the second sub-circuit may include a second capacitor between the microphone and the second bias sub-circuit.

Capacitance of the first capacitor may be equal to that of the second capacitor.

The fully differential circuit unit may include a fully differential amplifier and a resistive divider.

The resistive divider may include a variable resistor.

The fully differential circuit may include a first differential input stage and a second differential input stage having two input terminals, respectively, and a differential output stage having two output terminals. The first signal may be input to one input terminal of the first differential input stage, and the second signal may be input to one input terminal of the second differential input stage.

The resistive divider may include a first resistive divider connected between another input terminal of a first differential input stage and one output terminal of a differential output stage, and a second resistive divider connected between another input terminal of a second differential input stage and another output terminal of the differential output stage.

The signal processing circuit in accordance with the present disclosure includes all functions necessary for the analog signal processing circuit for the microphone. Since a plurality of functions are fully implemented by one circuit, electrical noise generated from the circuit may be minimized and current consumption may be reduced by simplifying a circuit arrangement. Moreover, an entire area of the circuit is reduced so that manufacturing cost may be reduced.

DETAILED DESCRIPTION OF THE EMBODIMENTS

Figure 1:
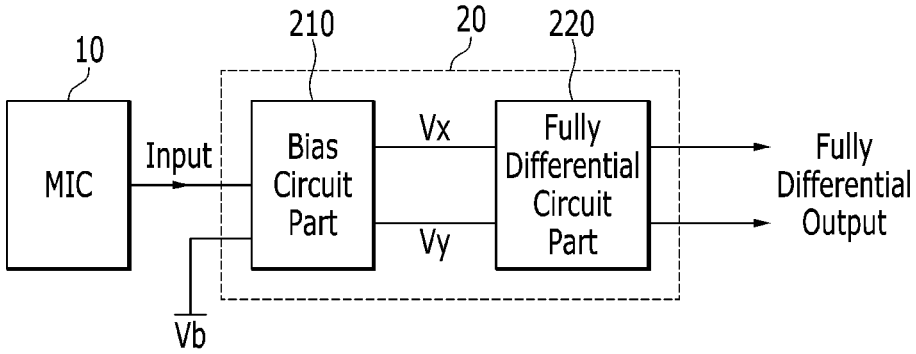
FIG. 1 is a block diagram illustrating an analog signal processing circuit according to an exemplary embodiment of the present inventive concept.

In the following detailed description, only certain exemplary embodiments of the present inventive concept have been shown and described, simply by way of illustration. As those skilled in the art would realize, the described embodiments may be modified in various different ways, all without departing from the spirit or scope of the present disclosure.

Accordingly, the drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

Hereinafter, an analog signal processing circuit of a microphone in accordance with an exemplary embodiment of the present inventive concept will be described in detail with reference to the accompanying drawings. The analog signal processing circuit of the microphone may simply refer to a signal processing circuit.

Figure 2:
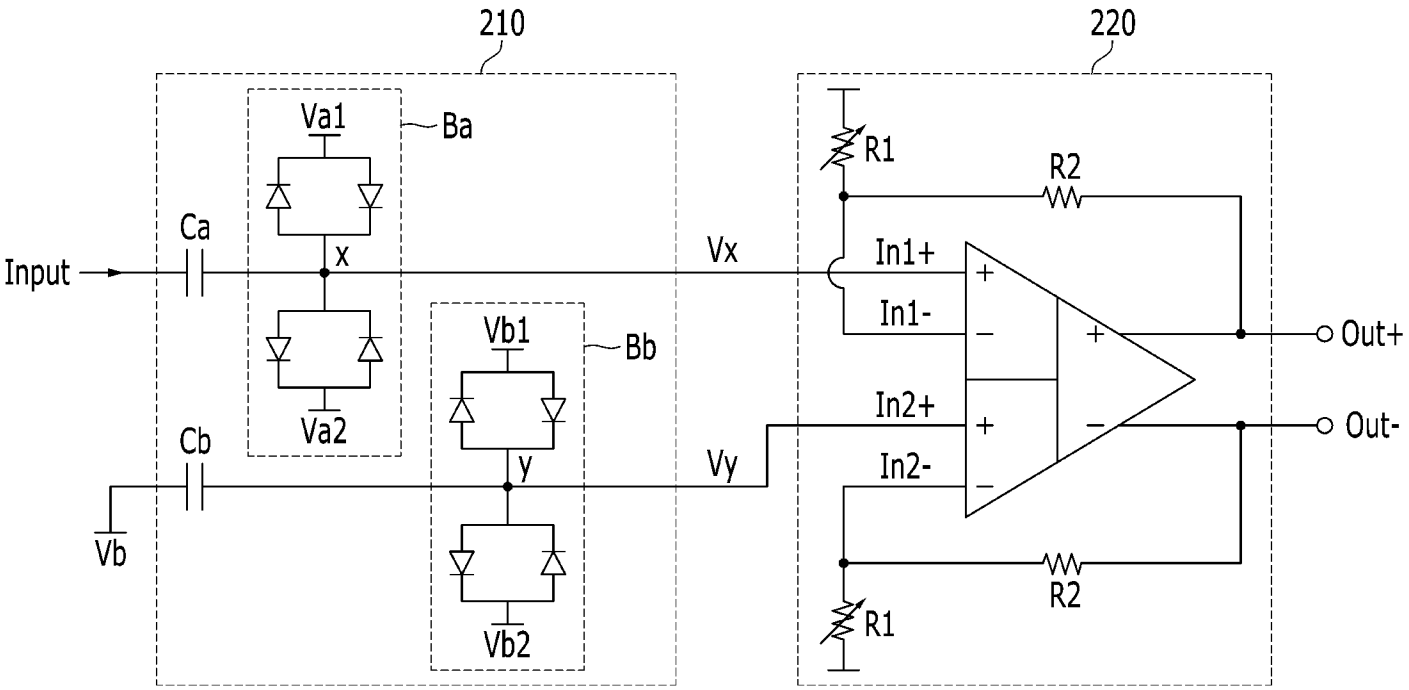
FIG. 2 is a circuit diagram illustrating an analog signal processing circuit according to an exemplary embodiment of the present inventive concept.

FIG. 1 is a block diagram illustrating an analog signal processing circuit according to an exemplary embodiment of the present inventive concept, and FIG. 2 is a circuit diagram illustrating an analog signal processing circuit according to an exemplary embodiment of the present inventive concept.

First, referring to FIG. 1, the analog signal processing circuit 20 in accordance with an exemplary embodiment of the present inventive concept receives a single signal as an input from a microphone 10 to output fully differential signals. A signal processing circuit 20 may convert changed capacitance from the microphone 10 into a voltage signal.

The microphone 10 receives a sound wave to generate an electrical signal according to vibration of the sound wave. For example, the microphone 10 may include a micro-electro-mechanical system (MEMS) microphone. In general, the MEMS microphone is divided into a MEMS microphone of a capacitance type and a MEMS microphone of a piezoelectric type. The MEMS microphone of the capacitance type includes a fixing electrode and a vibration membrane. When an external sound pressure according to the sound wave is applied to the vibration membrane, a capacitance value is changed because a distance between the fixing electrode and the vibration membrane changes. In this case, the microphone generates an electrical signal. Unlike the MEMS microphone of the capacitance type, the MEMS microphone of the piezoelectric type includes only a vibration membrane. When the vibration membrane is deformed by external sound pressure, the microphone generates the electrical signal due to a piezoelectric effect.

The signal processing circuit 20 includes a bias circuit unit 210 and a fully differential circuit unit 220. The bias circuit unit 210 and the fully differential circuit unit 220 may be configured by one circuit.

The fully differential circuit unit 220 converts a single signal output from the microphone into a fully differential signal that is advantageous for a common noise characteristic. The bias circuit unit 210 is basically connected to an input stage of the fully differential circuit unit 220, and may apply a desired voltage and minimize a DC offset between differential signals of a fully differential signal while converting the single signal into the fully differential signal.

Referring to FIG. 2, the bias circuit unit 210 includes two sub-circuits, that is, first and second sub-circuits separated from each other. The first sub-circuit receives an AC signal from the microphone 10 at an input stage to output a first signal Vx which is the AC signal with a desired DC bias voltage. The second sub-circuit receives a reference voltage Vb as an input to output a second signal Vy with the same bias voltage as that of the first signal Vx.

Each sub-circuit includes capacitors Ca and Cb and bias circuits Ba and Bb. The capacitor Ca of the first sub-circuit is connected to a node x, and the capacitor Cb of the second sub-circuit is connected to a node y. The capacitors Ca and Cb block a DC current from a signal provided to the input stage to allow the two nodes x and y to have the same environment if possible. That is, the capacitors Ca and Cb are used to block DC, and a similar impedance environment may be configured by the capacitors Ca and Cb. In order to configure the similar impedance environment, capacitance of the capacitor Ca of the first sub-circuit may be the same as capacitance of the capacitor Cb of the second sub-circuit.

The bias circuit Ba of the first sub-circuit is connected to the node x, and the bias circuit Bb of the second sub-circuit is connected to the node x. The bias circuits Ba and Bb apply a bias voltage to a path through which an input signal flows.

The bias circuit Ba includes a configuration where two anti-parallel diode pairs are connected to the node x. The anti-parallel diode pair includes two diodes which are connected in an anti-parallel scheme, and the two diodes are connected to each other to have a facing polarization. The anti-parallel diode pair generates great resistance while occupying a small area. A reference voltage Va1 is applied to one anti-parallel diode pair and a reference voltage Va2 is applied to the other anti-parallel diode pair. Accordingly, a bias voltage of (Va1+Va2)/2 which is a middle value of the reference voltages Va1 and Va2 may be applied to the node x.

Further, in the bias circuit Bb, two anti-parallel diode pairs are connected to the node y. A reference voltage Vb1 is applied to one of the anti-parallel diode pairs and a reference voltage Vb2 is applied to another anti-parallel diode pair. Accordingly, a bias voltage of (Vb1+Vb2)/2 which is a middle value of the reference voltages Vb1 and Vb2 may be applied to the node y.

The bias circuit Ba of the first sub-circuit and the bias circuit Bb of the second sub-circuit may have the same configuration. Moreover, a reference voltage to be applied to the bias circuit Ba may be the same as a reference voltage to be applied to the bias circuit Bb. That is, Va1 may be the same as Vb1, and Va2 may be the same as Vb2.

In accordance with an exemplary embodiment, the bias circuits Ba and Bb may include one anti-parallel diode pair, and may include a plurality of diodes which are connected in series, in parallel, and/or by another array arrangement. In this way, the bias circuit unit 210 configures a similar impedance environment in two nodes x and y using the capacitors Ca and Cb, and then biases the same DC voltage with a middle value of the two bias voltages using the bias circuits Ba and Bb. Accordingly, in the fully differential structure to receive a signal at one of two input stages, the bias circuit unit 210 may minimize distortion of an output signal by minimizing the DC offset of the differential AC signal.

The fully differential circuit unit 220 includes a fully differential difference amplifier (FDDA) and a resistive divider.

The FDDA may refer to a double differential structure which again divides a differential input of a general operational amplifier. The FDDA includes a first differential input stage and a second differential input stage as input stages. The first differential input stage includes two input terminals In1+ and In1−, and the second differential input stage includes two input terminals In2+ and In2−. Accordingly, the FDDA includes four input terminals. The FDDA includes a differential output stage with two output terminals Out+ and Out−. Two differential input voltages may be converted into a current through first and second input stages and may be amplified by an output stage. An ideal FDDA may amplify the differential voltage while suppressing a common mode voltage. The behavior of the FDDA is defined as follows. $V_{Out+}-V_{Out-}=A[(V_{In1+}-V_{In1-})-(V_{In2+}-V_{In2-})]$), where A represents a voltage gain from a certain differential input stage to an output.

The FDDA receives a first signal Vx output from the first sub-circuit of the bias circuit unit 210 through the input terminal (In1+) of the first differential input stage. A second signal Vy output from the second sub-circuit of the bias circuit unit 210 is input to the input terminal In2+ of the second differential input stage. In accordance with the exemplary embodiment, the first signal Vx may be input to the input terminal In2+ of the second differential input stage, and the second signal may be input to the input terminal In1+ of the first differential input stage. In addition, the first signal Vx may be input to an input terminal In1− of the first differential input stage and the second signal may be input to an input terminal In2− of the second differential input stage. In contrast, the first signal Vx may be input to the input terminal In2− of the second differential input stage and the second signal may be input to the input terminal In1− of the first differential input stage. In other words, the first signal Vx and the second signal Vy that may be input to input terminals have the same polarity in the first and second differential input stages, respectively. The FDDA outputs the fully differential signal through output terminals Out+ and Out−.

The resistive divider includes a first resistive divider connected between one input terminal In1− of the first differential input stage and an output terminal Out+ of the differential output stage, and a second resistive divider connected between one input terminal In2− of the second differential input stage and an output terminal Out− of the differential output stage. Accordingly, feedback loops of output voltages $V_{Out+}$ and $V_{Out-}$ are symmetrical to each other. The first and second resistive dividers may be connected to input terminals In1− and In2−, or In1+ and In2+, having the same polarity in the first and second differential input stages, but are not connected to an input terminal to which the first and second signals Vx and Vy are input.

For example, the first and second resistive dividers include two resistors R1 and R2. The second resistive divider R2 may be connected between the output terminal Out+ of the differential output stage and one input terminal In1− of the first differential input stage. The first resistive divider R1 may be connected between the one input terminal In1− of the first differential input stage and a reference voltage or a ground voltage. In the second resistive divider, the second resistor R2 may be connected to the output terminal Out− of the differential output stage and one input terminal In2− of the second differential input stage. The first resistor R1 may be connected between the one input terminal In2− of the second differential input stage and the reference voltage or the ground voltage. The first resistor R1 of the first and second resistors R1 and R2 may be a variable resistor. In accordance with the exemplary embodiment, the second resistor R2 may be a variable resistor, and the resistive divider may include a capacitor.

The resistive divider may set the voltage gain A of the FDDA. When output voltages $V_{Out+}$ and $V_{Out-}$ are connected so that the output voltages $V_{Out+}$ and $V_{Out-}$ are again transferred to inverting input terminals In1− and In2− through the second resistor R2 as shown in FIG. 2, the FDDA forms a non-inverting amplifier, and a voltage gain A is defined as follows.

$$A=(1+R2/R1)$$

Accordingly, as the voltage gain A of the FDDA is determined by a ratio of resistances in the two resistors R1 and R2, an amplification rate of the signal may be controlled by changing one of the resistances of the two resistors R1 and R2. As understood by those skilled in the art, when the FDDA forms the inverting amplifier circuit, the amplification rate of the signal may be controlled by changing one of the resistances in the two resistors R1 and R2.

As described above, the signal processing circuit 20 in accordance with an exemplary embodiment of the present inventive concept includes all three functions necessary to process an analog signal. An electrical noise may be minimized, current consumption may be reduced, and an area is reduced so that manufacturing cost may be reduced by integrating the circuit.

While this disclosure has been described in connection with what is presently considered to be practical exemplary embodiments, it is to be understood that the disclosure is not limited to the disclosed embodiments, but on the contrary, is intended to cover various modifications and equivalent arrangements included within the spirit and scope of the appended claims.

What is claimed is:

1. An analog signal processing circuit of a microphone, comprising:

a bias circuit including a first sub-circuit which receives a signal from the microphone to output a first signal and a second sub-circuit which receives a reference voltage to output a second signal; and a fully differential circuit which receives the first signal and the second signal to output a fully differential signal, wherein the first sub-circuit and the second sub-circuit include a first bias sub-circuit and a second bias sub-circuit to apply bias voltages, respectively, wherein each of the first and second bias sub-circuits comprises a first pair of anti-parallel diodes and a second pair of anti-parallel diodes directly connected to the first pair of anti-parallel diodes, and wherein, in each of the first and second bias sub-circuits, a first respective reference voltage is applied to the first pair of anti-parallel diodes, a second respective reference voltage is applied to the second pair of anti-parallel diodes, and a middle value of the first and second respective reference voltages is applied to a node between the first and second pairs of anti-parallel diodes.

2. The analog signal processing circuit of claim 1, wherein the first respective reference voltages of the first and second bias sub-circuits are different from each other, and the second respective reference voltages of the first and second bias sub-circuits are different from each other.

3. The analog signal processing circuit of claim 1, wherein the first sub-circuit comprises a first capacitor between the microphone and the first bias sub-circuit, and the second sub-circuit comprises a second capacitor between the microphone and the second bias sub-circuit.

4. The analog signal processing circuit of claim 3, wherein capacitance of the first capacitor is same as that of the second capacitor.

5. The analog signal processing circuit of claim 1, wherein the fully differential circuit comprises a fully differential amplifier and a resistive divider.

6. The analog signal processing circuit of claim 5, wherein the resistive divider comprises a variable resistor.

7. The analog signal processing circuit of claim 6, wherein the fully differential circuit comprises a first differential input stage and a second differential input stage having two input terminals, respectively, and a differential output stage having two output terminals, and the first signal is input to one input terminal of the first differential input stage, while the second signal is input to one input terminal of the second differential input stage.

8. The analog signal processing circuit of claim 7, wherein the resistive divider comprises a first resistive divider connected between another input terminal of the first differential input stage and one output terminal of the differential output stage, and a second resistive divider connected between another input terminal of a second differential input stage and another output terminal of the differential output stage.

* * * * *